United States Patent [19]

Freckleton et al.

[11] Patent Number: 4,571,863

[45] Date of Patent: Feb. 25, 1986

[54] GAS OPERATED SMOOTHING IRON

[76] Inventors: Howard O. Freckleton; John S. Bird, both of 5 Inverness Mews, London, England, W2 3JQ

[21] Appl. No.: 610,989

[22] PCT Filed: Oct. 19, 1983

[86] PCT No.: PCT/GB83/00267

§ 371 Date: May 15, 1984

§ 102(e) Date: May 15, 1984

[87] PCT Pub. No.: WO84/01589

PCT Pub. Date: Apr. 26, 1984

[30] Foreign Application Priority Data

Oct. 21, 1982 [GB] United Kingdom ..... 8230093

[51] Int. Cl.[4] ..... D06F 75/02

[52] U.S. Cl. ..... 38/86; 38/89; 126/412; 219/270; 431/344

[58] Field of Search ..... 38/86, 88, 89, 74; 126/230, 227, 38, 403, 406, 411, 412, 407; 431/344; 219/270, 280

[56] References Cited

U.S. PATENT DOCUMENTS

| | | | |
|---|---|---|---|
| 2,065,492 | 12/1936 | Hoff | 126/412 |
| 2,117,259 | 5/1938 | Slezak . | |
| 2,542,858 | 2/1951 | Boring | 38/89 X |
| 2,561,270 | 7/1951 | Felt | 431/344 X |
| 3,591,938 | 7/1971 | Arbulo . | |
| 3,648,680 | 3/1972 | Hein | 126/38 |
| 4,115,935 | 2/1951 | Toft | 38/88 |
| 4,207,032 | 6/1980 | Collaud et al. | 431/344 X |

FOREIGN PATENT DOCUMENTS

| | | |
|---|---|---|
| 1466996 | 1/1967 | France . |
| 134063 | 11/1919 | United Kingdom . |
| 2077771 | 12/1981 | United Kingdom . |

*Primary Examiner*—Werner H. Schroeder
*Assistant Examiner*—Andrew M. Falik
*Attorney, Agent, or Firm*—Cushman, Darby & Cushman

[57] ABSTRACT

A smoothing iron has a body structure with a handle (5) and a baseplate (36), a gas burner (44), for heating the baseplate (36), and a tank (8) to contain gas, for fuelling the burner (44), maintained under pressure in liquid form, for example liquefied butane or propane gas. In a preferred form, the body structure has a first portion (1) with the handle (5) and tank (8), and a second portion (2) with the baseplate (36), those portions being air-spaced with the exception of connections (4) of very low heat-conductive capacity. The handle (5) and tank (8) are advantageously integrally moulded of plastics material.

27 Claims, 10 Drawing Figures

101
104
104
107

170
173
167
162
169
172
171

GAS OPERATED SMOOTHING IRON

This invention relates to the field of smoothing irons for laundry purposes and, while not restricted thereto, is particularly applicable to irons for domestic use.

There is a need for an iron which can be used conveniently in situations where there is no electricity supply, and also not a supply of domestic house gas. Butane and propane gas in liquid form has become readily available in aerosol-type cans which can readily be applied for filling gas-fuelled appliances through a non-return valve.

It is the object of the present invention to provide an improved iron which can be fuelled with a supply of liquefied gas, such as butane or propane, under pressure.

According to the present invention a smoothing iron comprises a body structure having a handle and a baseplate for application to the material to be ironed, a gas burner for heating said baseplate, and a tank for liquefied fuel gas under pressure.

The body structure preferably comprises a first portion including the handle and said tank, and a second portion including the baseplate. To reduce heat conduction to a minimum between the first and second portions, advantageously they are spaced by an air gap over the whole of their mutually opposed surfaces, except where connected by connection means of very low heat-conductive capacity, e.g. a small number, say two or three, island sites of plastics material.

The handle and tank may advantageously be included integrally in a single moulding of plastics material, and preferably the tank is disposed to the rear of the handle and may have an underside opening closed in fluid-tight manner by an openable, e.g. releasable, closure. In a preferred arrangement, the closure defines chamber means opening to the exterior and at least in part closed by an openable cover, said chamber means serving to house power-supply and switching means for an electrically-powered ignition device for the gas burner. The switching means may include timing means. Said closure may carry a burner jet for the gas burner.

Fuel flow control means comprising a flow restricter and a shut-off valve may be disposed in a flow path between the tank and burner jet, and said switching means and said shut-off valve advantageously have a common operating member such as a slide projecting laterally from the body structure and operable with the fingers.

In a preferred arrangement the flow restricter permits variation of flow rate of fuel by variation of compression of a deformable porous material arranged in the flow path. Advantageously, the flow restricter includes means for increasing flow restriction, to the point of cut-off if desired, with rise of temperature.

For filling of the tank with liquefied gas, there may be provided a spring-loaded inlet valve accessible from the exterior, e.g. at the top of the tank, and adapted to receive the conventional filler stem of an aerosol tank of the fuel.

There may be provided a flow restricter control member, e.g. a knob, for control of the rate of feeding of gas to a burner. In a first preferred embodiment, the tank contains wick means leading to a gas outlet passage. The wick is disposed on a seating and is under pressure from a presser element, such as a ball bearing or a plastic restricter, the tightness of which can be controlled by rotation of the control member, thereby to give fine adjustment of the rate of flow of gas to a burner jet.

In a second embodiment, the liquid fuel of the tank passes through cellular material to an adjustable flow restricter having one or more layers of cellular material under variable compression from a manual control, and an expandible restricter responsive to increase of temperature to exert increased pressure may be interpolated between the manual control and the one or more layers.

The gas jet may conveniently be a ceramic or other heat-resistant jet which is mounted in a wall of the end plate and which is directed into an air inlet opening of the base portion of the iron.

The base portion may comprise a base proper, for contacting the material to be ironed, and a cover housing which is spaced from the base proper and on which the handle portion is mounted in spaced position. Within the cover housing there may be provided a top plate which with the base proper bounds a flame space having outlets to the exterior. A gas/air supply path for the burner comprises preferably a member having the air inlet referred to above, followed by a venturi passage, followed by an expansion and outlet chamber which has an apertured wall through which the mixture can pass for ignition externally thereof. The supply path member may conveniently be seated into an opening of the burner top plate.

For ignition of the gas/air mixture emerging through the apertured wall the ignition device may be an element adapted to become heated by the presence of the gas/air mixture or a wire heated by electric current or an electronic timed ignition device. In one form, the ignition device is a wire element connected to a current supply in the form of a battery housed in one of the chambers of the end plate and under the control of an on-off switch and a timer which limits the period for which current is available at each time of use, e.g. a pulse timer which may remain in operation for, say, up to 30 seconds until the flame is ignited, and which will remain on time throughout its operating cycle. The on-off switch may be incorporated with or operated by the on-off valve for the gas, or may be a separately operable switch mounted on or incorporated in the handle portion.

In order that the nature of the invention may be readily ascertained, two embodiments of gas-operated smoothing iron in accordance with the various aspects thereof are hereinafter particularly described with reference to the figures of the accompanying drawings, wherein.

Figure 1:
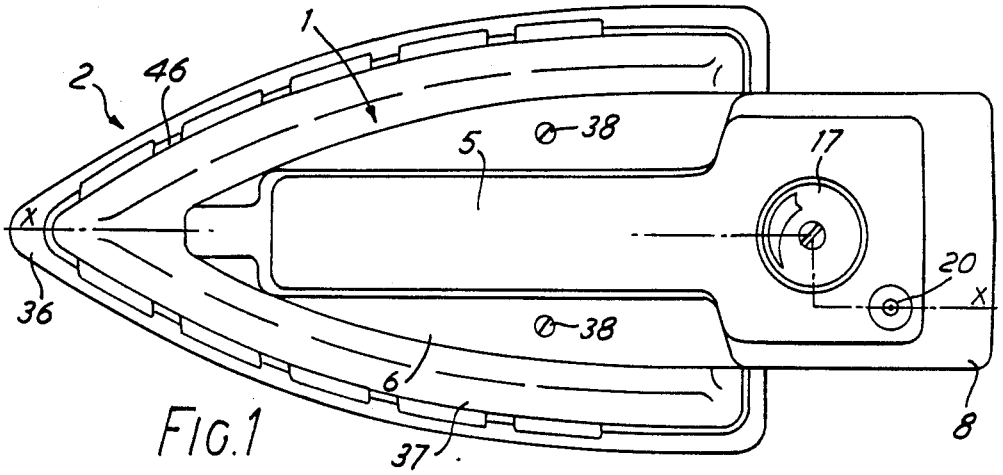
FIG. 1 is a plan view of a first embodiment of the iron.
Figure 2:
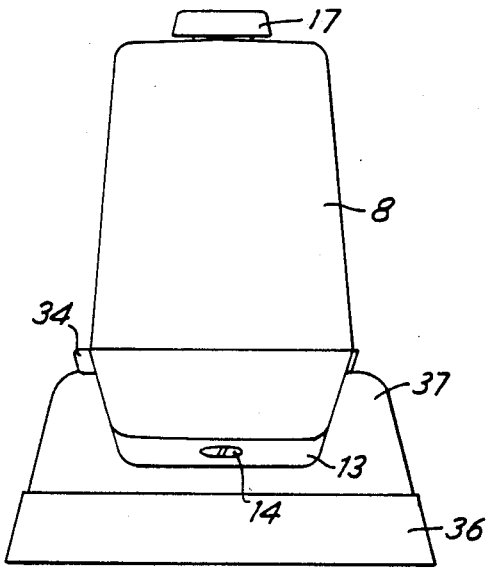
FIG. 2 is a rear end elevation thereof.

Referring to FIGS. 1 to 5, the smoothing iron comprises essentially two main portions, viz. a handle and fuel supply portion indicated generally at 1, and a base portion 2, these being connected only by screws 3 passed through heat-insulating spacing pillars 4.

The handle portion 1 comprises a handle proper 5 spaced from a lower part 6 so as to define an opening 7 for the fingers grasping the handle 5. At the rear end of the handle portion there is an integral tank 8 which has a large opening at its underside and is closed at that opening by an end plate 9 having a sealing gasket 10. The end plate 9 may be threaded into the lower end of the tank 8, or may be secured by one or more tightening screws (not shown). The end plate 9 bounds a first chamber 11 and a second chamber 12 which can be closed by a removable cover 13 secured by a screw 14 threaded into a wall or pillar 15. The tank 8 has in its upper wall an opening in which is engaged a gas flow control assembly 16. On the exposed outer end of the filler valve assembly 16 there is engaged a fuel-flow control knob 17 which can be used to rotate the entire assembly 16 for altering the fuel flow between high and low conditions.

Figure 4:
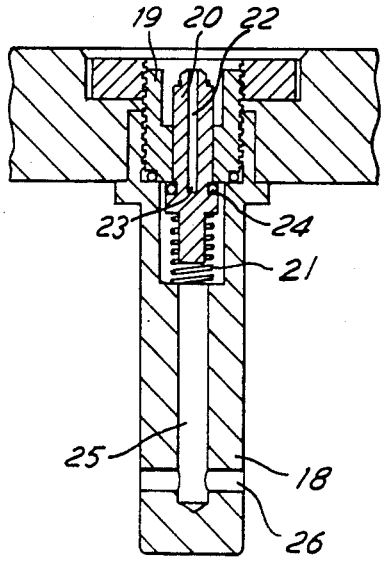
FIG. 4 is a partial section, on a larger scale, to show details of a filler valve.

Referring to FIG. 4, there is shown a filler valve which includes a shaft 18 in the enlarged upper end of which there is threaded a sleeve 19 which receives slidably a valve element 20 urged upwardly by a compression spring 21. The valve element 20 has an axial passage 22 leading to a radial passage 23, and the valve element 20 normally seats against the sleeve 19 through a gasket 24. When the filler stem of a conventional can of butane gas is applied to the valve element 20, the valve element is pushed downwardly against the spring 21 and the radial passage 23 becomes opened to admit liquid butane into the upper end of the shaft 18, from whence it passes down an axial bore 25 to a radial bore 26 and then into the interior of the tank 8.

For control of fuel flow, the assembly 16 carries a wick 27 which (see FIG. 5) is compressed between a seating 28 and a ball bearing 29. The assembly 16 is constructed in such a manner that rotation of it by the knob 17 causes, by means of screw-threading, a variation of the axial pressure with which the ball 29 is pressed against the wick. This controls the rate at which liquid fuel can pass from the wick 27 into an axial bore 30 of the seating 28.

The axial bore 30 leads to the interior of an on-off control valve indicated generally at 31 (see FIG. 3) and which includes a valve element 32 spring-urged upwardly by a spring 31. The valve element 32 is under the control of a push button or lever 34 which protrudes at one side of the iron (see FIG. 2) for control of the gas flow by the fingers. The outlet of the control valve 31 leads to a ceramic gas jet 35 disposed partly in the chamber 12 and partly externally thereof.

Figure 3:
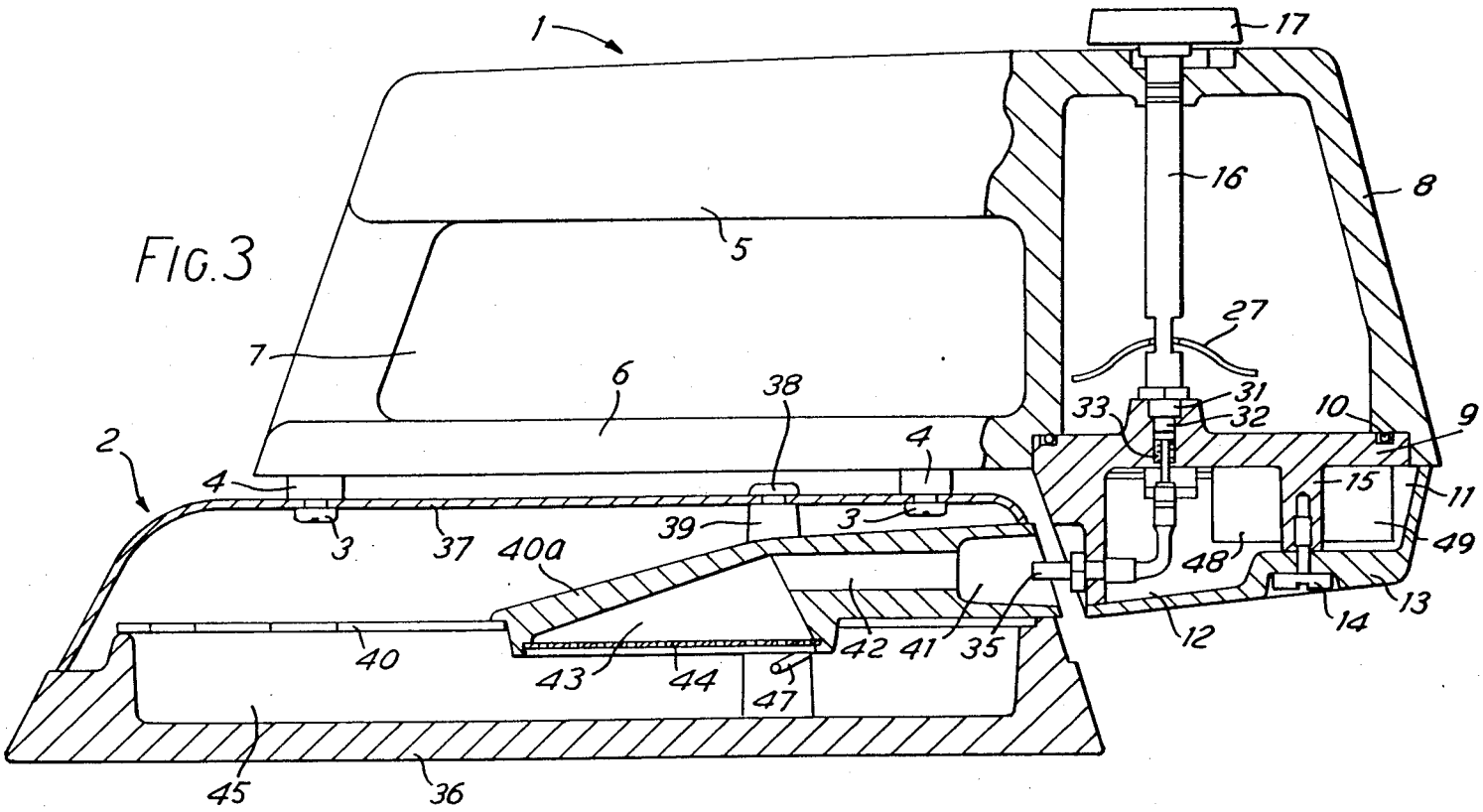
FIG. 3 is a partial central vertical longitudinal section thereof.
Figure 5:
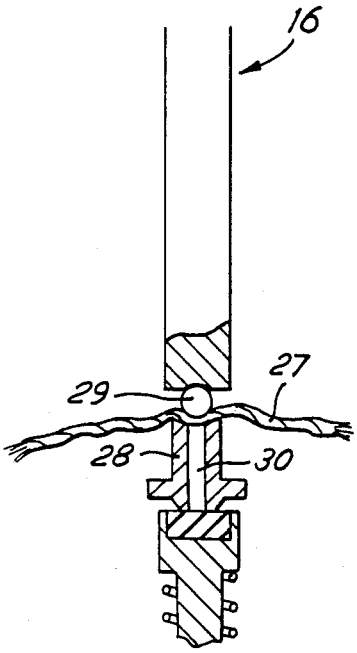
FIG. 5 is a schematic view to show a fuel-flow control.

Referring now to FIG. 3, the base portion 2 of the iron comprises a baseplate 36 on which a cover housing 37 is secured by means of two screws 38 engaged into pillars 39. A top plate 40 within the base portion has a large opening to receive therein a burner cowl 40*a* which is formed with an air inlet 41, a venturi 42 and an outlet 43 covered by an apertured plate 44. The air inlet 41 receives the outlet end of the ceramic jet 35 with a large clearance about it for entry of combustion air.

When the gas supply has been turned on and gas is issuing from the jet 35, a mixture of gas and air flows through the apertures of the plate 44 and burns at the underside thereof in a space 45. Oultets 46 for the products of combustion, (see FIG. 1) are arranged along both sides of the iron.

For ignition of the fuel/air supply there is provided a hot-wire electrode 47 which is powered with electric current from a battery 48 situated in chamber 12 and under the control of a timer 49 which limits the heating time of the wire to, say, 10 seconds at each time of operation of a control, e.g. the valve push-button 34 or another switch control sited elsewhere.

It is to be noted that the sole connection between the relatively hot base portion 2 and the relatively cool handle portion 1 is the pillars 4 and screws 3, so that the handle proper 5 and the fuel tank 8 can remain relatively cool.

Adjustment of the electric timer 49, and insertion and replacement of the battery 48, can be obtained by removing the cover 13.

A thermostat may be included, to cause the heating means to cut out at a predetermined temperature, e.g. ranges of 70°-100° C., 100°-130° C., and 160°-210° C.

Figure 7:
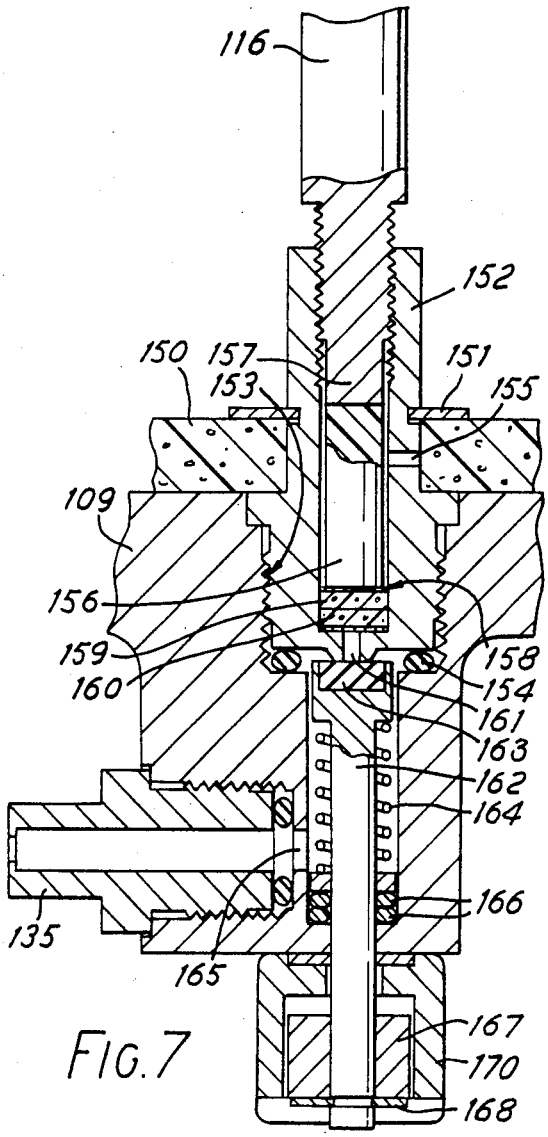
FIG. 7 is a central vertical section, to an enlarged scale, of a gas flow control system of the embodiment of FIG. 6.
Figure 6:
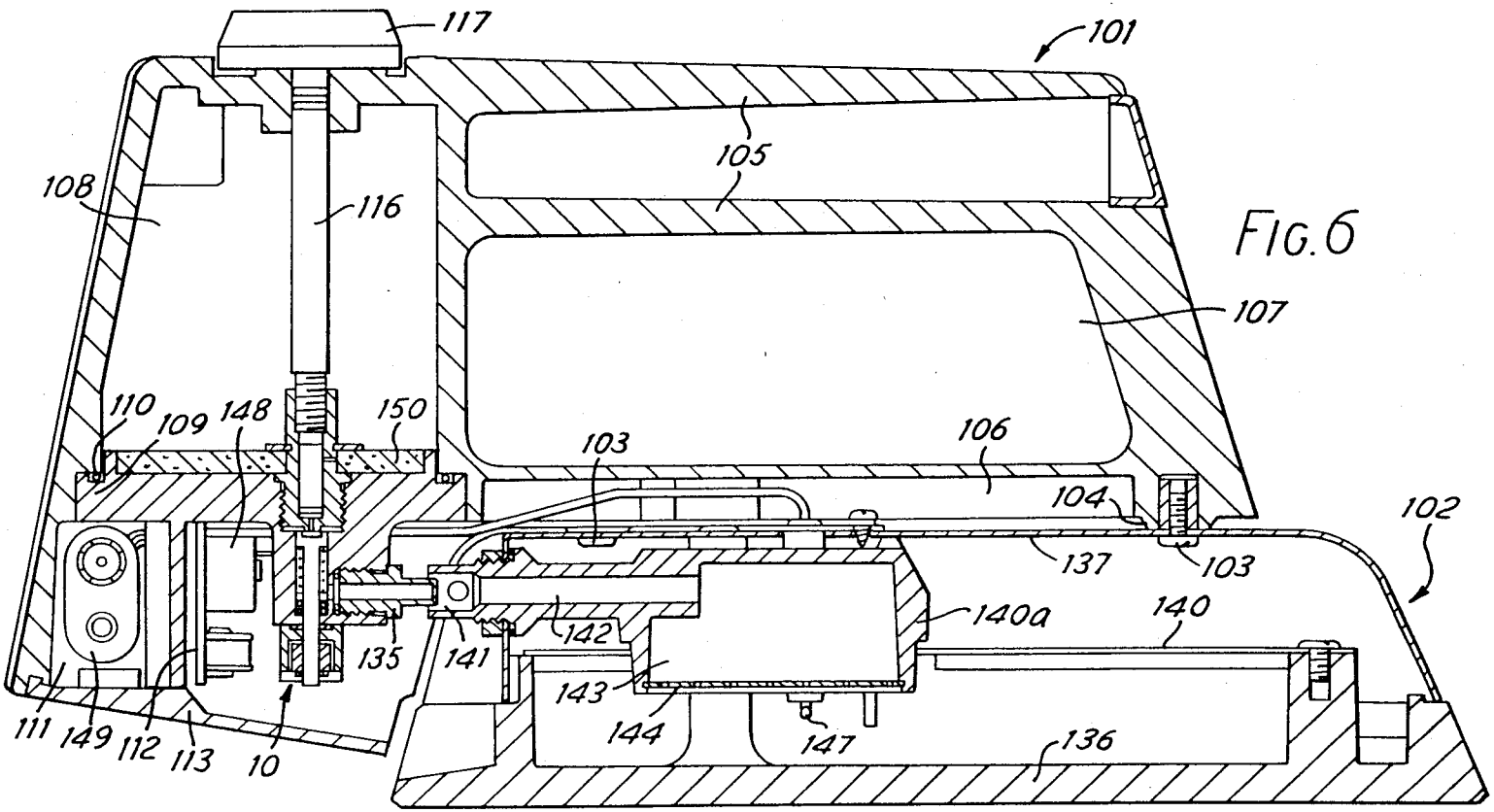
FIG. 6 is a central vertical section of a second embodiment.
Figures 8, 9:
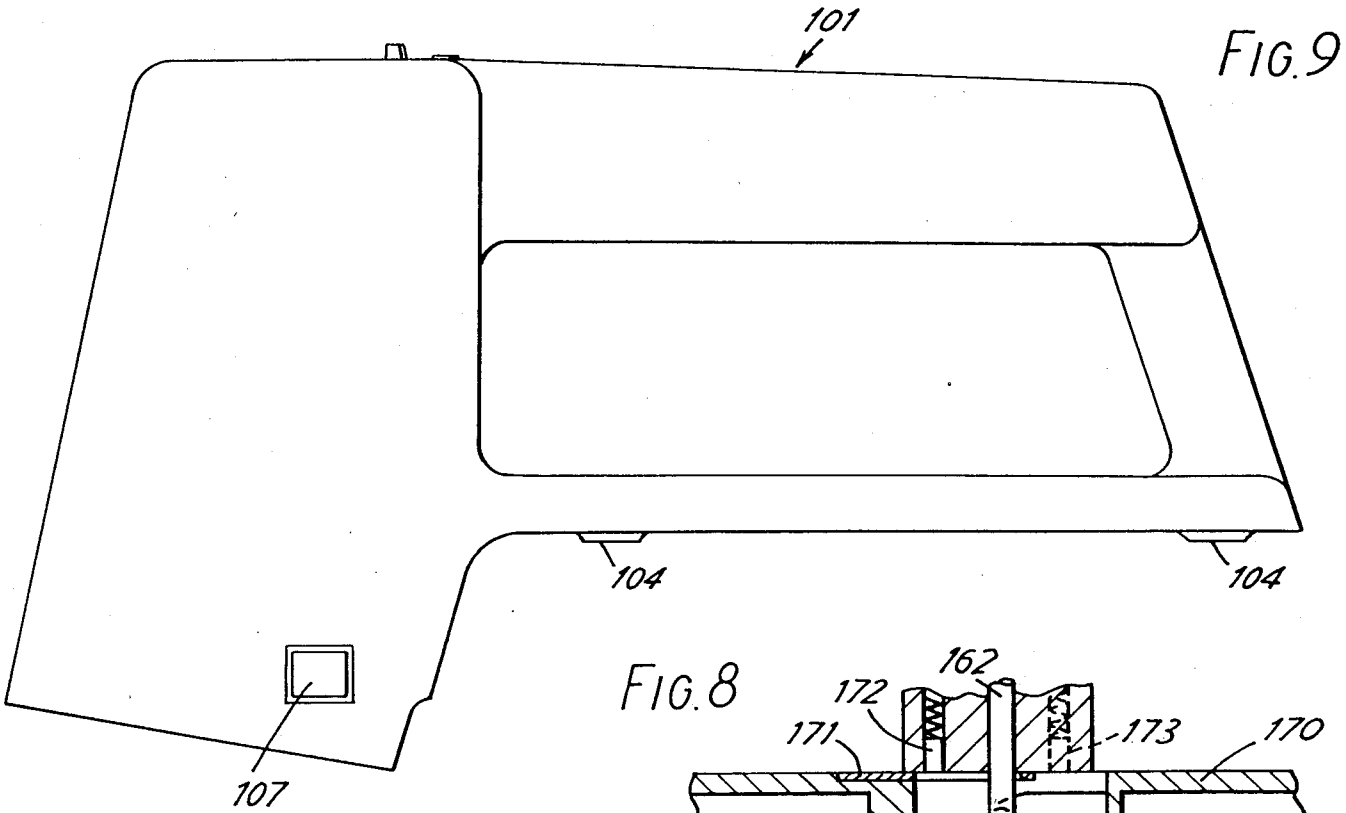
FIG. 8 is a sectional scrap view to show details of a combined gas valve control and ignition switch.
FIG. 9 is a side elevation of the upper portion of the iron.

Referring now to FIGS. 6 to 9 the general structure of the iron is similar to that of the embodiment shown in FIGS. 1 to 5, and components having the same function, although of different shape, are indicated in FIGS. 6 and 7 by the same reference numerals increased by 100. The iron is again in two major portions 101 and 102 which are connected solely by screws 103 engaged into three pillar-forming portions 104 arranged one at the front and one at each side of the moulded handle, and with an air space 106 between the two portions.

The gas control system is shown in detail in FIG. 7. The interior of the tank 108 contains liquefied butane gas. In the base of the tank there is seated a layer of polyurethane foam material 150 which is of that kind in which the cells or pores communicate with each other. This layer of foam material 150 is secured in position by means of a spring metal clip 151 engaged in a recess in a valve body 152 which is threaded into a recess 153 in the general body of the end plate 109 and is sealed thereto by abutting onto an O-ring 154. In the wall of the valve body 152 there is a radial opening 155 which permits flow of liquid gas from the tank interior through the pores of the foam layer 150 into the interior of the valve body 152. Within the valve body 152 there is seated a loose plastic slug 156 which is abutted by the lower end portion 157 of the rod 116 of the valve assembly, said portion 157 being threaded into the valve body 152 so that rotation of the rod 116 causes axial movement of the end portion 157 and thus of the slug 156. Between the lower end of the slug 156 and the lower end wall of the valve body there are seated a layer 158 of fine-mesh wire gauze, an upper layer 159 of 2 mm. polyurethane foam, and a lower layer 160 of 2 mm. polyurethane foam. Thus, by rotation of rod 116, a variable compression can be exerted on the superposed layers 159,160 of foam, to provide a fine control of rate of release of gas through a valve opening 161 of the valve body.

The plastic slug 156 expands with rise of temperature, and is so designed that, after a predetermined rise of temperature is experienced in the general tank and valve structure, the slug has expanded sufficiently to compress the two layers 159-160 of foam to the extent where they no longer permit passage of gas. The range might be, for example 15° C. to a maximum of 33° C., to give automatic cut-off at the upper end of the range, with automatic regulation of the flame over that range. As the iron cools, the plastic slug contracts and again permits increased flow of gas through the layers 159–160.

The valve opening 161 is normally closed by a stop valve element 162 carrying a nitrile rubber end washer 162 abutting a valve seating formed on the valve body. The stop valve element 162 is spring-loaded to cut-off position by a compression spring 164. If the element 162 is moved downwardly, against its spring-loading, gas is permitted to flow from the opening 161 past the element 162 and through a lateral opening 165 to the ceramic jet 135. The element 162 is provided with a gas-tight sliding seal formed by two superposed O-rings 166 which are themselves compressed by the same spring 164.

For shifting the element 162 downwardly, when required, to permit flow of gas to the jet, element 162 carries at its lower end a cam follower block 167 secured thereon by a spring metal clip 168 and coacting with a camming formation 169 of a cross-slide 170 (see FIG. 8) which protrudes at its ends (see FIG. 9) from the body of the iron so as to be movable with the fingers, with snap action caused by the spring 164, into positions of opening and closing of the valve. The cross slide 170 also has a metal contact bridge plate 171 which, in the valve-open position of the slide, connects two spring-loaded contacts 172–173 to complete the electronic spark circuit of the igniter electrode 147. The spark ignition device may be arranged to spark at intervals of approximately 2 seconds until ignition is obtained. The ignition system remains operational under extremely low current as long as the control of the ignition system is in the "ON" position, and throughout the operational cycle of the iron.

Figure 10:
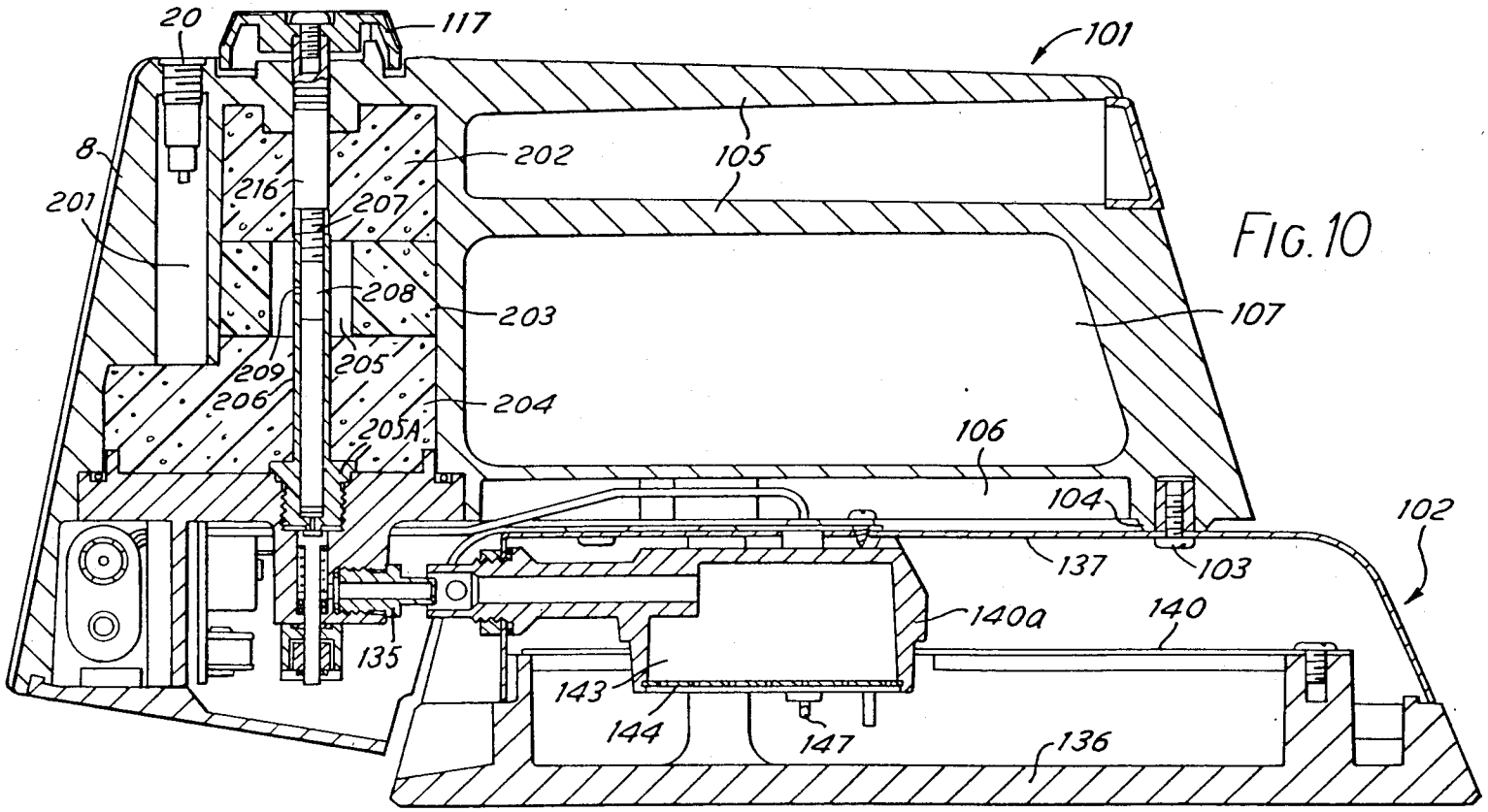
FIG. 10 is a section on the line X—X of the iron shown in FIG. 1.

The iron shown in FIG. 10 is generally similar to that shown in FIG. 6 and differs only in respect of the filler valve, tank, and outlet valve arrangement. Filler valve 20 opens into an inlet conduit 201 formed as a cylindrical bore through the end wall portion of tank 8. Conduit 20 opens into tank 8, approximately one third of the tank depth above the floor of the tank.

The tank 8 is substantially filled by three pieces of open cell foam 202, 203 and 204. A flow restricter mechanism extends from control knob 117 to adjacent jet 135 through the three foam pieces. Piece 203 has a wide circular bore therethrough through which passes the flow restricter mechanism leaving an annular clearance therebetween 205.

The flow restricter mechanism comprises at its lower end an arrangement as shown in FIG. 7 from the level of the tank floor 109 downwards. The mechanism therefore includes a slug 156 bearing at its lower end upon fine mesh wire gauze 158, layers of polyurethane foam 159 and 160 and gauze 160 seated in the base of a valve body 205 corresponding to valve body 152. The closure of the valve opening and the arrangement of the cross-slide 170 and cam follower block 167 is as shown in FIG. 7.

The restricter mechanism shown in FIG. 10 differs in that valve body 205 has a longer upwardly extending tubular stem 206 having at its upper end a threaded portion 207 engaging a threaded end portion of a rod 216 turned by control knob 117 with which it engages at its upper end such that it may slide axially in knob 117 but is rotated thereby.

Within valve body 206 below rod 216 is a loose slug 208 positioned adjacent a bore for gas passage 209 formed in the tubular wall of valve body 206 and communicating with annular space 205. Below slug 208 is plastics slug 206 which like slug 209 is a loose fit to allow gas to pass it in the valve body 206.

In operation gas is introduced through filler valve 20 and liquid gas progressively fills the lower part of the tank. When the liquid level reaches the mouth of bore 201, liquid gas is unable to diffuse through the foam in the tank sufficiently fast to prevent liquid rapidly building up in the bore 201. The valve 20 will therefore indicate that the tank is apparently full shortly after the liquid level reaches bore 201.

Bore 201 is positioned such that when the tank is loaded as aforesaid, liquid fuel will not be at a level reaching annular spce 205 even if the iron is stood on its back.

When gas flow is started by operation of slide 170, liquid evaporates to gas at the annular space 205 and passes through bore 209 as gas. This is in contrast to the arrangement of FIG. 7.

The restricter mechanism provided by foam discs 159, 160 now has only to deal with gaseous fuel instead of liquid fuel and as a result this part of the mechanisn can if desired be replaced by any conventional gas flow restricter such as a needle valve.

The foam occupying tank 8 is preferably a polyether or polyester open call foam, polyether foam being particularly preferred.

We claim:

1. A smoothing iron comprising a body structure, a handle associated with said body structure, a baseplate for application to material to be ironed, a gas burner for heating said baseplate, a tank incorporated in said body structure for storing liquefied fuel gas under pressure, said tank having an inlet for liquefied gas, a non-return inlet valve in said inlet for liquefied gas whereby a user may fill and replenish said tank thus producing a substantial accumulation of liquefied fuel gas therein, means defining a fuel flow path from the tank to the burner, and outlet valve in said fuel flow path having a closed position in which exit of fuel from the tank is prevented and an open position in which exit of fuel from the tank to flow to the burner is permitted, and a flow restrictor in said flow path, wherein said flow restrictor includes a deformable porous material arranged in said flow path, and means for compressing said porous material to a selectable degree to regulate fuel gas flow.

2. A smoothing iron, as claimed in claim 1, wherein said body structure includes a first portion including said handle and said tank, and a second portion including said baseplate.

3. A smoothing iron, as claimed in claim 2, wherein said first portion and said second portion are spaced by an air gap over the whole of their mutually opposed surfaces except where connected by connection means of very low heat-conductive capacity.

4. A smoothing iron, as claimed in claim 2, wherein said handle and said tank are included integrally in a moulding of plastics material.

5. A smoothing iron, as claimed in claim 2, wherein said tank is disposed to the rear of said handle and has an underside opening closed in fluid-tight manner by an openable closure.

6. A smoothing iron, as claimed in claim 5, wherein said closure defines chamber means opening to the exterior and at least in part closed by an openable cover, and wherein power-supply and switching means for an electrically powered ignition device for the gas burner are housed within said chamber means.

7. A smoothing iron, as claimed in claim 5, wherein said closure carries a burner jet for said gas burner.

8. A smoothing iron, as claimed in claim 7, wherein fuel flow control means comprising a flow restricter and a shut-off valve are disposed in a flow path between said tank and said burner jet.

9. A smoothing iron, comprising a body structure having a handle and a baseplate for application to material to be ironed, a gas burner for heating said baseplate, wherein the body structure includes a tank for liquefied fuel gas under pressure, a first portion of the body structure including said handle and said tank, and a second portion including said baseplate, the tank being disposed to the rear of said handle and having an underside opening closed in fluid-tight manner by an openable closure defining chamber means opening to the exterior and at least in part closed by an openable cover, a power-supply and a switching means for an electrically powered ignition device for the gas burner being housed within said chamber means, wherein fuel flow control means comprising a flow restricter and a shut-off valve are disposed in a flow path betwee said tank and said burner jet and said switching means and said shut-off valve having a common operating member.

10. A smoothing iron, comprising a body structure having a handle and a baseplate for application to material to be ironed, a gas burner for heating said baseplate, wherein the body structure includes a tank for liquefied fuel gas under pressure, a first portion of the body structure including said handle and said tank, and a second portion including said baseplate, the tank being disposed to the rear of said handle and having an underside opening closed in fluid-tight manner by an openable closure which carries a burner jet for said gas burner and wherein fuel control means comprising a flow restricter and a shut-off valve are disposed in a flow path between said tank and said burner jet, said flow restrictor permitting variation of flow rate of fuel by variation of compression of a deformable porous material arranged in said flow path.

11. A smoothing iron, as claimed in claim 10, wherein said flow restricter includes means for increasing flow restriction with rise of temperature.

12. A smoothing iron comprising a body structure having a handle associated with the body structure and a baseplate for application to material to be ironed, a gas burner for heating said baseplate, a tank for liquefied fuel gas under pressure included in the body structure, means defining a flow path for fuel gas from the tank to the burner, and a flow restrictor in said flow path, wherein the flow restrictor includes a deformable porous material arranged in said flow path and means for compressing said porous material to a selectable degree to regulate fuel gas flow.

13. A smoothing iron, as claimed in claim 12, wherein said flow restrictor further includes means for increasing flow restriction with rise of temperature.

14. A smoothing iron, as claimed in claim 12, wherein said means for increasing flow restriction comprises a temperature expansible member arranged between the porous material and an abutment member so as to participate in applying pressure to the porous material.

15. A smoothing iron, as claimed in claim 12, wherein incorporated in said body said tank has an inlet for liquefied gas, a non-return inlet valve in said inlet for liquefied gas whereby a user may fill an replenish said tank thus producing a substantial accumulation of liquefied fuel gas therein, means defining a fuel flow path from the tank to the burner, and an outlet valve in said fuel flow path having a closed position in which exit of fuel from the tank is prevented and an open position in which exit of fuel from the tank to flow to the burner is permitted.

16. A smoothing iron, as claimed in claim 12, wherein the body structure includes a first portion including said handle and said tank, and a second portion including said baseplate.

17. A smoothing iron as claimed in claim 16, wherein said first portion and said second portion are spaced by an air gas over the whole of their mutually opposed surfaces except where connected by connection means of very low heat conductive capacity.

18. A smoothing iron, as claimed in claim 16, wherein said handle and said tank are included integrally in a moulding of plastics material.

19. A smoothing iron, as claimed in claim 16, wherein said tank is disposed to the rear of said handle and has an underside opening closed in fluid-tight manner by an openable closure.

20. A smoothing iron, as claimed in claim 19, wherein said closure defines chamber means opening to the exterior and at least in part closed by an openable cover, and wherein power-supply and switching means for an electrically powered ignition device for the gas burner are housed within said chamber means.

21. A smoothing iron, as claimed in claim 19, wherein said closure carries a burner jet for said gas burner.

22. A smoothing iron, as claimed in claim 12, comprising a shut-off valve disposed in the flow path from said tank to said burner.

23. A smoothing iron, as claimed in claim 22, wherein the switching means and the shut-off valve have a common operating member.

24. A smoothing iron comprising a body structure, a handle associated with said body structure, a baseplate for application to material to be ironed, a gas burner for heating said baseplate, a tank incorporated in said body structure for storing liquefied fuel gas under pressure, said tank having an inlet for liquefied gas, a non-return inlet valve in said inlet for liquefied gas whereby a user may fill and replenish said tank thus producing a substantial accumulation of liquefied fuel gas therein, means defining a fuel flow path from the tank to the burner, and an outlet valve in said fuel flow path having a closed position in which exit of fuel from the tank is prevented and an open position in which exit of fuel from the tank to flow to the burner is permitted, said tank including means for providing during filling of the tank a signal that liquefied fuel in the tank has reached a predetermined level, said flow path including a gas flow conduit having a gas inlet positioned within the tank such that the gas inlet will be above liquefied fuel gas in the tank in any orientation of the iron if the tank has been filled only to said predetermined level.

25. A smoothing iron, as claimed in claim 24, wherein said flow path includes a flow restrictor which permits variation of flow rate of fuel by variation of compression of a deformable porous material arranged in said flow path.

26. A smoothing iron comprising a body structure, a handle associated with said body structure, a baseplate for application to material to be ironed, a gas burner for heating said baseplate, a tank incorporated in said body structure for storing liquefied fuel gas under pressure, said tank having an inlet for liquefied gas, a non-return inlet valve in said inlet for liquefied gas whereby a user may fill and replenish said tank thus producing a substantial accumulation of liquefied fuel gas therein, means defining a fuel flow path from the tank to the burner, and an outlet valve in said fuel flow path having a closed position in which exit of fuel from the tank is prevented and an open position in which exit of fuel from the tank to flow to the burner is permitted, wherein the flow path includes a flow restrictor assembly positioned substantially within the volume of the tank.

27. A smoothing iron, as claimed in claim 26, wherein the flow restrictor assembly includes means permitting variation of the fuel flow rate by variation of compression of a deformable porous material arranged in said flow path.

* * * * *